United States Patent [19]

Cinquegrani

[11] 4,185,597

[45] Jan. 29, 1980

[54] SELF-SUPERCHARGING DUAL PISTON ENGINE APPARATUS

[76] Inventor: Vincent J. Cinquegrani, 5409 E. Pinchot, Phoenix, Ariz. 85018

[21] Appl. No.: 883,657

[22] Filed: Mar. 6, 1978

[51] Int. Cl.[2] ..... F02B 33/00

[52] U.S. Cl. ..... 123/68; 123/57 B; 123/71 R; 123/74 AC

[58] Field of Search ..... 123/57 A, 57 B, 62, 123/63, 68, 71 R, 73 B, 74 R, 74 AC, 75 RC, 75 CC; 417/493

[56] References Cited

U.S. PATENT DOCUMENTS

| | | | |
|---|---|---|---|
| 912,751 | 2/1909 | Steely | 123/62 |
| 976,858 | 11/1910 | Easthope | 123/69 |
| 1,378,254 | 5/1921 | MacDonald | 123/74 AC |
| 1,624,024 | 4/1927 | Svensson et al. | 123/73 B |
| 1,881,789 | 10/1932 | Mantle | 123/63 |
| 2,000,267 | 5/1935 | White | 123/71 R |
| 2,334,688 | 11/1943 | Norton | 417/493 |
| 2,339,848 | 1/1944 | Feeney | 123/62 |
| 2,381,832 | 8/1945 | Mansoff | 123/74 R |
| 2,963,008 | 12/1960 | Waldrop | 123/62 |
| 3,981,280 | 9/1976 | Franke | 123/71 R |

FOREIGN PATENT DOCUMENTS

| | | | |
|---|---|---|---|
| 583813 | 9/1933 | Fed. Rep. of Germany | 123/62 |
| 396369 | 10/1931 | United Kingdom | 123/62 |

*Primary Examiner*—Charles J. Myhre
*Assistant Examiner*—David D. Reynolds
*Attorney, Agent, or Firm*—H. Gordon Shields

[57] ABSTRACT

Internal combustion engine apparatus includes a dual piston with a plurality of intake ports having reed type check valves.

25 Claims, 2 Drawing Figures

SELF-SUPERCHARGING DUAL PISTON ENGINE APPARATUS

BACKGROUND OF THE INVENTION

1. Field of the Invention

This invention relates to internal combustion engines, and, more particularly, to internal combustion engines having dual pistons for self-supercharging characteristics.

2. Description of the Prior Art

Internal combustion engines have used dual pistons for various purposes. By "dual" as used in the present application is meant two pistons coaxially aligned on a common piston rod or connecting rod. An early example of a dual piston engine is disclosed in U.S. Pat. No. 758,189, dated Apr. 26, 1904. The U.S. Pat. No. 758,189 discloses a pair of pistons in which the bottom piston is employed for cushioning and for scavaging purposes. The combustion chamber for the engine is above the top piston, and the bottom of the two pistons are not used.

U.S. Pat. No. 912,012, dated Feb. 9, 1909, also discloses a dual piston engine in which two combustion chambers are used on top of the two pistons. The bottom of the top piston is used to charge both combustion chambers. No supercharging is employed with either the U.S. Pat. No. 912,012 or with the previously discussed U.S. Pat. No. 758,189.

Another type of dual piston engine is disclosed in U.S. Pat. No. 1,504,957, dated Aug. 12, 1924. The U.S. Pat. No. 1,504,957 uses the bottom piston for scavenging and cushioning purposes, not dissimilar to that disclosed in the U.S. Pat. No. 758,189.

In U.S. Pat. No. 1,983,237, dated Dec. 4, 1934, the bottom piston of the dual piston engine is used primarily for scavenging purposes.

In U.S. Pat. No. 2,303,966, dated Dec. 1, 1942, a dual piston engine is disclosed in which supercharging is accomplished from the bottom of the top piston. Only a single combustion chamber is used, and the combustion chamber is located above the top piston. Sleeve valves are used to control the inlet and outlet of a fuel-air mixture from below and above the top piston.

In all of the above-described patents, excep the U.S. Pat. No. 758,189, which discloses a diesel type internal combustion engine, carburetion is employed at the air intake, and before any supercharging, regardless of the path of the air or fuel-air mixture. That is, the carburetion is ahead of any supercharging that is accomplished by means of the dual piston arrangement. Two inherent problems are involved in such an arrangement. The first problem is a decrease in efficiency due to the pumping of the fuel vapors. The second problem is that the presence of the fuel interferes with the lubrication of the pistons by washing out lubricating oil. Those two problems are overcome by the arrangement of the present invention in which the carburetion is placed between the combustion chamber and the air inlet, or after the supercharger. Thus there is an increase in efficiency of the supercharging or air pumping by eliminating the pumping of the fuel vapors and there is no interference with the lubrication of the pistons.

SUMMARY OF THE INVENTION

The invention described and claimed herein comprises an internal combustion engine utilizing a dual piston arrangement in which supercharging is accomplished from beneath the top piston and from above the bottom piston, or, if desired, from only above the bottom piston, and axially arranged or oriented reed type check valves are employed to control the flow of air for the supercharging, and carburetion for the engine is accomplished between the supercharger and the combustion chamber.

Among the objects of the present invention are the following:

to provide new and useful internal combustion engine apparatus;

to provide new and useful dual piston internal combustion engine apparatus;

to provide new and useful self-supercharging internal combustion apparatus;

to provide new and useful internal combustion engine apparatus utilizing reed type check valves;

to provide new and useful supercharged internal combustion engine apparatus in which carburetion is accomplished between the supercharger and the combustion chamber;

to provide new and useful internal combustion engine apparatus having dual pistons of different diameters; and to provide new and useful dual piston internal combustion apparatus having a novel bulkhead disposed between the pistons.

DESCRIPTION OF THE PREFERRED EMBODIMENT

Figure 1:
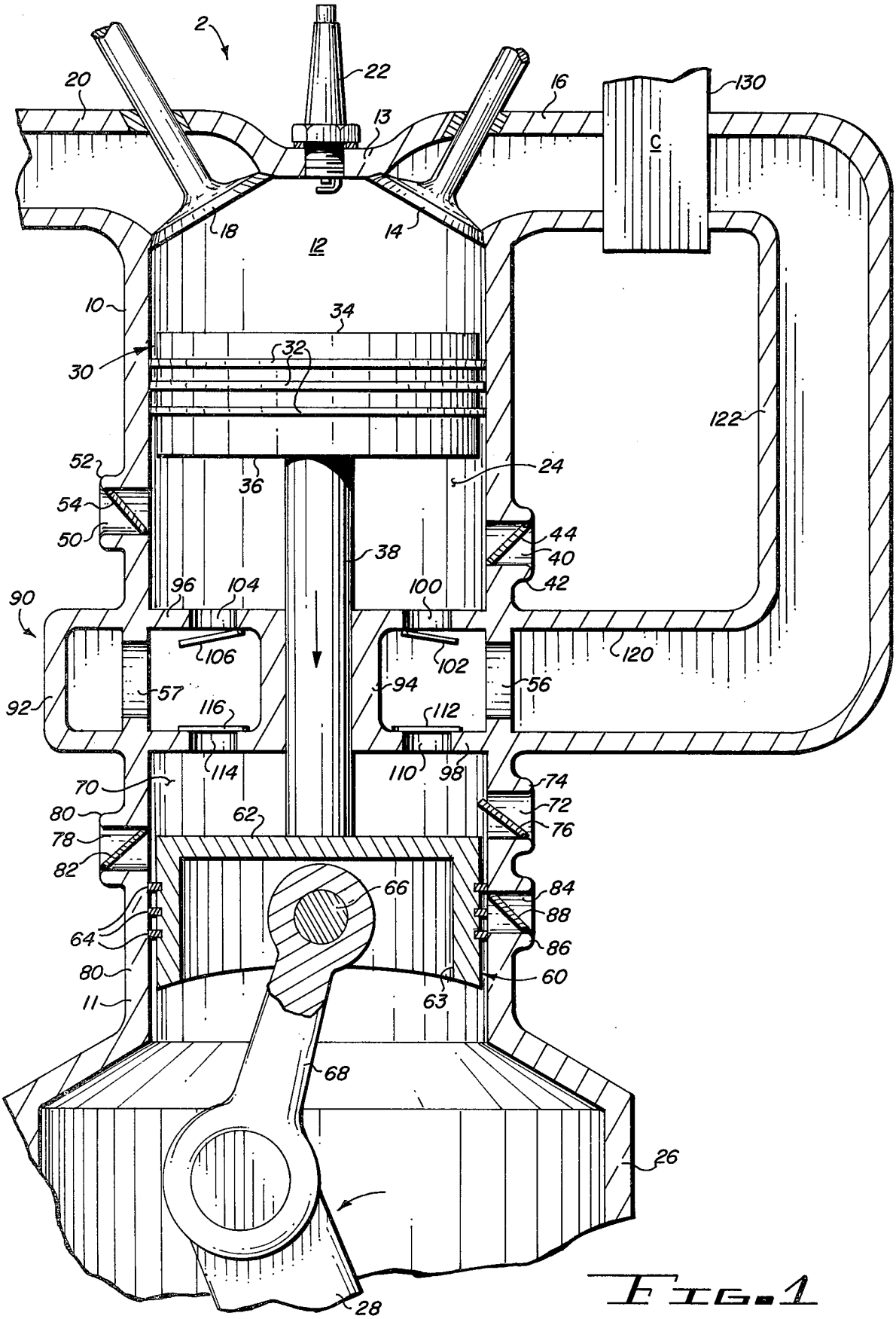
FIG. 1 is a view in partial section of apparatus of the present invention.

FIG. 1 is a view in partial section of an internal combustion engine apparatus 2 embodying the present invention. Only elements pertaining to the present invention and to its understanding are illustrated. Other elements typical of internal combustion engines are well known and understood. The engine 2 includes a cylinder having two portions, an upper cylinder portion 10 and a lower cylinder portion 11, both of which are coaxial with respect to each other and separated or spaced apart by a bulkhead 90. The upper portion of the upper cylinder 10 comprises a combustion chamber 12, closed by a cylinder head 13. Communicating with the combustion chamber 12 is an intake valve 14 which separates the combustion chamber 12 from an intake manifold 16. The intake manifold and intake valve perform substantially the same function in the engine 2 as they do in any internal combustion engine. Similarly, an exhaust valve 18 and an exhaust manifold 20 also communicate with the combustion chamber 12 to provide their well known function for the engine 2. A spark plug 22 is illustrated as secured to the engine and extending through the cylinder head 13 into the combustion chamber 12 to provide the necessary spark for the ignition of the fuel-air mixture within the combustion chamber 12.

The lower portion of the engine 2 includes a crankcase 26 in which is disposed a crank 28. The crankcase 26 is secured to the lower portion of the lower cylinder 11.

Within the upper cylinder 10 is a top piston 30. The top piston 30 includes a plurality of circumferentially extending rings 32, which are compression and oil rings, well known in the art. The piston 30 includes a top 34 and a bottom 36. The top 34 functions as a typical piston head with respect to the combustion chamber 12. The bottom 36 of the piston 30 comprises a "piston head" for a top supercharging member 24 which comprises the lower portion of the upper cylinder 10 beneath the piston 30. The top supercharging chamber 24 is defined by the walls of the cylinder 10, the bottom 36 of the piston 30, and an upper wall 96 of a bulkhead 90.

Air is taken into the top supercharging chamber 24 through a plurality of axially oriented or separated intake ports, such as intake ports 40 and 50. The intake ports 40 and 50 extend through the cylinder 10. The intake port 40 includes a boss 42, which extends about the port 40, and a reed type check valve 44 secured to the boss 40 for opening and closing the intake port 40. The intake port 50 is similar to intake port 40 in that it includes a raised boss 52 extending about the port 50 and a reed type check valve 54 which controls the opening and closing of the port 50. As the piston 30 moves upwardly in the cylinder 10, the reed type check valves 44 and 54 open to allow air to flow into the upper supercharging chamber 24. As the piston 30 moves downwardly, the check valves 44 and 54 close to prevent the air within the supercharging chamber 24 from flowing outwardly through the valves 40 and 50.

Within the lower cylinder 11 is a lower or bottom piston 60. The bottom piston 60 includes a piston head 62, which comprises the top of the piston, and a skirt 63 which extends downwardly from the piston head 62. The skirt is, of course, cylindrical in configuration. A plurality of sealing rings 64 are appropriately secured to and carried by the skirt 63 of the piston 60. A piston pin 66 is secured to the skirt 63 of the piston 60, and a piston rod or connecting rod 68 extends between the piston pin 60 and the crank 28. The connecting rod 68 is appropriately journaled for rotation with repsect to both the pin 66 and the crank 68, as in well known and understood.

Connecting the top piston 30 and the bottom piston 60 is a rigid connecting rod 38. Extending through the lower cylinder 11 are a plurality of intake ports for a lower supercharging chamber 70 which is defined by, and extends between, the cylinder 11, the piston head 62 of the bottom piston 60, and a lower wall 98 of the bulkhead 90.

Communicating with the bottom supercharging chamber 70 are a plurality of intake ports, such as intake port 72, intake port 78, and intake port 84. The intake ports 72, 78, and 84, are substantially identical to the intake ports 40 and 50, described above in conjunction with cylinder 10. Each port includes a raised boss disposed above the port and a reed type check valve which controls the flow of air into the chamber 70 through the port. For example, the intake port 72 includes a circumferentially extending boss 74 and a reed type check valve 78. Similarly, the intake port 78 includes a boss 80 and a reed type check valve 82 controlling the flow of air through the boss and through the port. Likewise, the intake port 84 includes a circumferentially extending boss 86 and a reed type check valve 88 secured to the boss and controlling the flow of air through the port 84.

It will be noted that the intake ports 72, 78, and 88 are spaced axially with respect to the lower cylinder 11. That is, they are not radially spaced apart on a common circumference. Rather, they are spaced apart or separated axially from each other with respect to the longitudinal (vertical, as shown) axis of the cylinder. The axial arrangement of the intake ports and check valves improves the volumetric efficiency for the supercharging chambers by keeping the residual volume of the chambers minimal. With an axial disposition or orientation of the inlet ports, there is sequential opening of the check valves to improve the air flow into the supercharger chambers with a resulting improvement in the air pumping capability and efficiency of the apparatus.

Between the upper and lower cylinders 10 and 11 is the bulkhead 90, which includes an outer wall 92, an inner cylindrical wall 94, the upper wall 96, and a lower wall 98. The connecting rod 38 extends through the inner cylindrical wall 94. Appropriate sealing means may be used to seal the connecting rod 38 and the cylindrical wall 94.

A plurality of apertures extend through the upper and lower walls 96 and 98 to provide communication with the chambers 24 and 70, respectively. As illustrated in FIG. 1, an aperture 100 and an aperture 104 extend through the upper wall 96 of the bulkhead 90 to provide communication between the upper supercharging chamber 24 and the interior of the bulkhead 90, which comprises a transfer manifold 120. The apertures 100 and 104 are appropriately controlled by reed type check valves 102 and 106, respectively. Similarly, a pair of apertures 110 and 114 extend through the lower wall 98 to provide communication between the lower supercharging chamber 70 and the transfer manifold 120 within the bulkhead 90. The flow of air through the apertures 110 and 112 is appropriately controlled by a pair of reed type check valves 112 and 116, respectively.

The transfer manifold 120 includes a vertical portion or runner 122 which extends to a carburetor 130 or to a fuel system. The carburetor 130 is in turn connected to the intake manifold 16.

For the following description of the operation of the engine 10, it is assumed that crank 28 is moving in a counterclockwise direction, as indicated by the arrow adjacent the crank 28, and that the pistons 30 and 60 are moving downwardly in their respective cylinders 10 and 11, as indicated by the direction of the arrow on the connecting rod 38.

Downward movement of piston 30 results in displacement of the air within the supercharger chamber 24. The check valves 44 and 54 close to prevent the air within chamber 24 from flowing outwardly through the intake ports 40 and 50. The check valves 44 and 54 close when the air stops flowing into the chamber 24. When the pressure within the supercharging chamber 24 increases to where it is greater than the pressure within the transfer manifold 120, the reed type check valves 102 and 106, which control the flow of air from the chamber 24 into the manifold 120 through the apertures 100 and 104, respectively, will open. The air within the chamber 24 will thus flow into the transfer manifold 120 and through the carburetor 130, where fuel is mixed with the air.

When the pressure within the transfer manifold 120 exceeds the pressure within the lower supercharging chamber 70, the reed valves 112 and 116 close, thus preventing a flow of air from the manifold 120 through the apertures 110 and 114, respectively, into the chamber 70. The downward movement of the piston 30 accordingly results in the displacement of air within the chamber 24 to cause the air which flowed into the chamber 24 through the intake ports 40 and 50 on the upward movement of the piston 30 to flow into the transfer manifold 120. At the same time, the downward movement of piston 60 causes the reed type check valves 76, 82, and 88 to open in their respective ports 72, 78, and 84, to allow air to flow into the chamber 70.

It will be noticed with respect to chamber 70 that the axial arrangement or separation of the intake ports 72, 78, and 84 results in the sequential opening of the respective check valves 76, 82, and 88, as the piston 60, or the piston head 62 moves by each of the intake ports and the check valves. Thus as illustrated in FIG. 1, the check valve 76 is shown in open position, allowing the air to flow through the intake port 72 into the chamber 70 since the piston head 62 of the piston 60 has moved past or downwardly with respect to the port 72. However, the piston head 62 is just approaching the intake port 78, and its check valve 82 is still in a closed position. The piston head 62 is still remote from the intake port 84 and thus it is closed by its check valve 88. As the piston 60 continues its downward movement, the intake port 78 and the intake port 84 will be sequentially opened as the piston head moves by each port. The check valves open, of course, in response to the differential pressure within the lower supercharging chamber 40 and the ambient air pressure outside the engine 2 to which the intake ports 72, 78, and 84, like the intake ports 40 and 50, are subject.

On the upward movement of the pistons 30 and 60, air pumping is accomplished in the chamber 70, while the chamber 24 is subject to the inward flow of air through its ports 40 and 50 as the piston 30 moves past the respective ports. The movement of air from the supercharging chamber 70 into the transfer manifold 120 is accomplished in substantially the same manner as described above with respect to the upper supercharging chamber 24. That is, the check valves 76, 82, and 88 of the intake ports 72, 78, and 84, respectively, close when the air stops flowing into the supercharging chamber 70. The check valves 112 and 116 in the lower wall 98 of the bulkhead 90 open in response to a pressure differential between the supercharging chamber 70 and the transfer manifold 120 to allow the air from the chamber 70 to flow into the transfer manifold. As the check valves 112 and 116 open in response to the pressure differential, the check valves 102 and 106 close the apertures 100 and 104 in the upper wall 96 to prevent the flow of air from the transfer manifold 120 to the upper supercharging chamber 24. There is thus supercharging action taking place in the engine 2 with each stroke of the engine.

Since there is no fuel present in the intake air to either of the supercharging chambers 24 or 70, there is no pumping of fuel vapors accomplished by the engine and there is no interference with lubrication of the pistons by the fuel (gasoline) washing the lubricating oil from around the pistons.

The air pumping capability of the engine is maximized by utilizing both the bottom of the top piston 30 and the top of the bottom piston 60. Moreover, residual volume in the supercharger or pumping chambers 24 and 70 is kept to a minimum by locating the openings or apertures and their reed valves in the upper and lower walls of the bulkhead 90, and between the pistons 30 and 60 and substantially at the end of the travel of the respective pistons. The apertures through the top and bottom walls, or upper and lower walls 96 and 98, respectively, of the transfer manifold 90 thus efficiently transfer substantially all of the air from the chambers 24 and 70 in response to the reciprocating motion of the pistons. The substantially highest possible volumetric efficiency of the engine is thus accomplished to pump the most air possible. Moreover, residual volume is also kept to a minimum by placing the intake check valves away from the end of the stroke of the pistons, as shown in FIG. 1. Thus the intake ports 40 and 50 are spaced apart or away from the top wall 96 of the bulkhead 90, and the intake ports 72, 78, and 84 are placed away from the lower or bottom wall 98 of the bulkhead 90, which upper and lower walls define or comprise the end of the stroke of the pistons.

The use of the reed type check valves provides several advantages over prior art valves for the supercharging chambers. For example, they are simple, inexpensive, they open and close automatically, and no timing is required. Moreover, their use minimizes the discrete elements associated with the intake ports and with the transfer ports 100, 104, 110, and 114 in the bulkhead.

For structural integrity of the engine apparatus, particularly with respect to the cylinder walls 10 and 11, it is noted that the bulkhead 90 extends about and through the cylinder walls. To that end, apertures 56 and 57 are shown extending through the cylinder walls to allow unrestricted communication within the transfer manifold 120.

Although the engine 2 is of a four-stroke type, four compression strokes are achieved from the air below the top piston and from air on top of the bottom piston per engine cycle.

Figure 2:
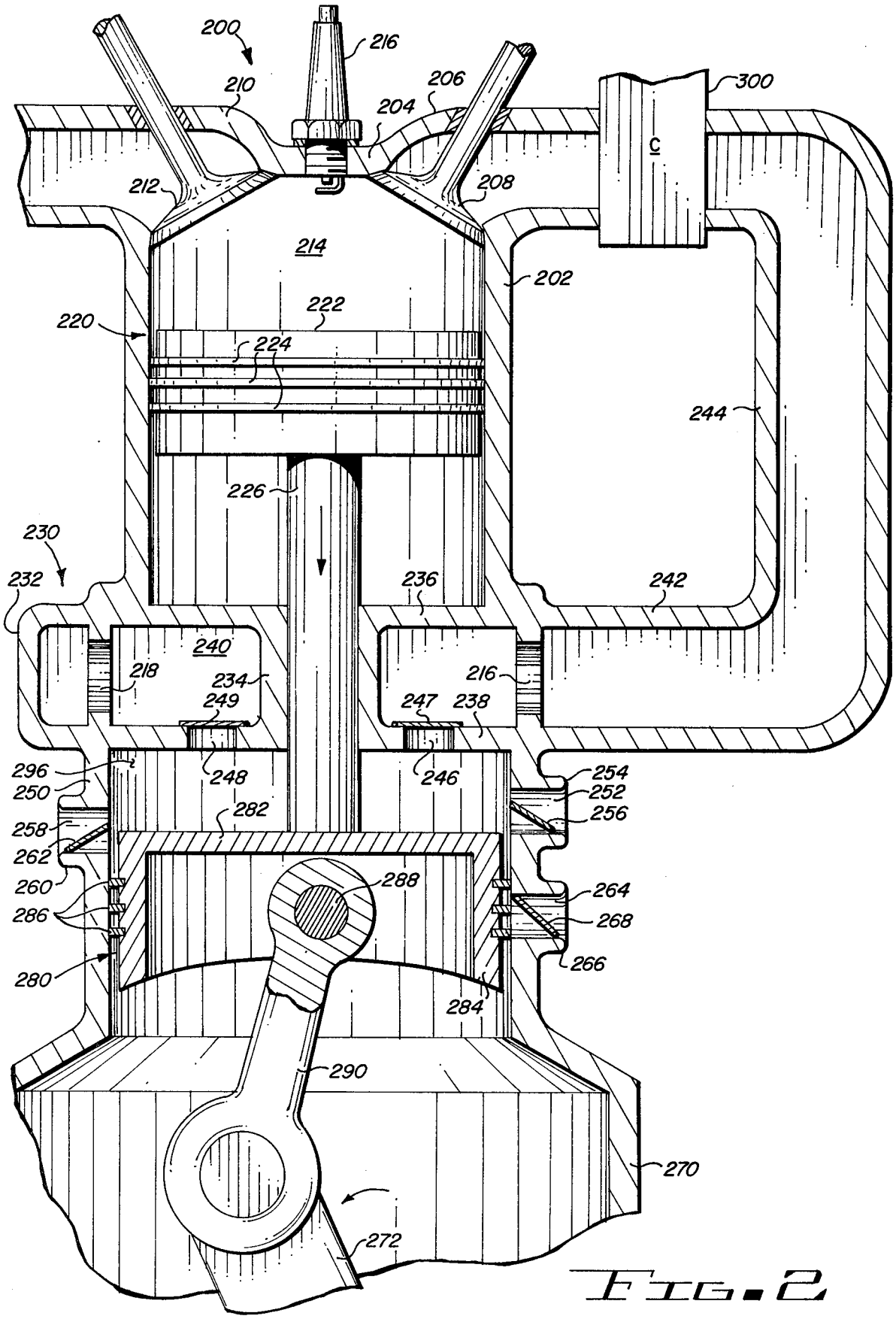
FIG. 2 is a view in partial section of an alternate embodiment of the apparatus of FIG. 1.

FIG. 2 is an alternate embodiment of the internal combustion apparatus of FIG. 1. An internal combustion engine 200 is illustrated in partial section in FIG. 2. The engine 200 includes an upper cylinder 202 closed by a cylinder head 204. An intake manifold 206, with an intake valve 208, connects with the cylinder head 204. Similarly, an exhaust manifold 210 and an exhaust valve 212 also are secured to the cylinder head 204. Within the cylinder 202 and beneath the cylinder head 204 is a combustion chamber 214. The intake manifold 206, with its valve 208, provide for the flow of a fuel and air mixture into the combustion chamber 214. The fuel and air mixture within the combustion chamber 214 is ignited by a spark plug 216 which is secured to, and extends through, the cylinder head 204 and communicates with the combustion chamber 214. The products of combustion, the exhaust gases, flow out of the combustion chamber 214 past the exhaust valve 212 and into the exhaust manifold 210.

Within the upper cylinder 200 is a piston 220 which reciprocates in the cylinder. The piston 220 includes a piston head 222 which is the top or uppermost portion of the piston 220 and which defines the bottom of the combustion chamber 214. A plurality of rings 224 are shown extending circumferentially about the piston 220.

Disposed beneath the upper cylinder 200, and coaxial therewith, is a lower cylinder 250. The diameter of the lower cylinder 250 is greater than the diameter of the upper cylinder 200.

The lower cylinder 250 is in turn connected to, and communicates with, a crank 270. A crank 272 is shown within the crank case 270. The direction of travel, or revolution, of the crank 272 is indicated by an arrow adjacent the crank.

Between the upper cylinder 200 and the lower cylinder 250 is a bulkhead 230, the interior of which comprises a transfer manifold 240. The bulkhead 230 includes an outer wall 232, an inner wall 234, an upper wall 236, and a lower wall 238. The respective walls define the transfer manifold 240 within the bulkhead 230. The transfer manifold 240 also includes a horizontal runner 240 which extends outwardly from the bulkhead 230, and a vertical runner 244 which extends upwardly from the horizontal runner. The vertical runner 244 in turn communicates with the intake manifold 206. Between the intake manifold 206 and the transfer manifold 240 is a carburetor 300. The arrangement of the carburetor with respect to the transfer manifold and the intake manifold in the embodiment of FIG. 2 are substantially the same as that shown in FIG. 1 with respect to the carburetor, the transfer manifold, and the intake manifold illustrated and discussed in conjunction with FIG. 1.

Extending through the lower wall 238 of the bulkhead 230 are a pair of apertures 246 and 248, and a pair of reed type check valves 247 and 249 are disposed within the transfer manifold to control the opening and closing of the apertures 246 and 248, respectively, and thus control the flow of air through the apertures.

Within the lower cylinder 250 is a lower or supercharger piston 280. The piston 280 includes a piston head 282 and a cylindrical skirt 284 extending downwardly from the head 282. A plurality of rings 286 extend circumferentially about the skirt 284. The piston rings 286 perform the sealing functions, well known and understood in the art. A piston or connecting rod 290 is connected to the piston 280 by a piston pin 288. The piston rod 290 is in turn secured to the crank 272.

The lower piston 280 is connected to the upper piston 220 by a rigid piston rod 226 that extends through the inner wall 234 of the bulkhead 230. The inner wall 234 is cylindrical in configuration to accommodate the circular piston rod 226.

A supercharger chamber 296 is defined within the lower cylinder 250 and beneath the lower wall 238 of the bulkhead and the head 282 of the lower piston 280.

Air flows into the supercharger chamber 296 through a plurality of intake ports which are axially spaced apart from each other and which extend through the lower cylinder wall 250. Three such intake ports 252, 258, and 264, are illustrated in FIG. 2. The intake ports 252, 258, and 264 respectively include an outwardly extending boss 254, 260, and 266, and a reed type check valve 256, 262, and 268. As discussed above in conjunction with FIG. 1, the reed type check valves operate automatically on a pressure differential basis in that they open to allow flow of air into the supercharger chamber 296 when the atmospheric or ambient pressure is greater than the pressure within the chamber 296, and the check valves close when the pressure within the chamber 296 exceeds the ambient or atmospheric pressure. Thus, when air stops flowing into the supercharger chamber 296, the reed valves 256, 262, and 268 automatically close to prevent the outward flow of air from the chamber 296 through the ports 252, 258, and 262.

With respect to FIG. 2, if it is assumed that the direction of travel of the crank 272 is in the direction indicated by the arrow, then the direction of travel of the pistons 220 and 280 is downwardly, as indicated by the arrow on the piston rod 226. Accordingly, the supercharger piston 280 is in an intake mode and, since the piston head 282 is downwardly or below the reed type check valves 256 and 262 of the intake ports 252 and 258, respectively, the check valves 256 and 262 are open to allow air to flow into the supercharger chamber 296. However, intake port 264, which is lower than or below, axially speaking, the intake ports 252 and 258, has not opened because the piston head 282 has not yet exposed the port 264 to the pressure within the chamber 296. Accordingly, the check valve 268 is in its closed position preventing communication between the atmospheric or ambient pressure outside the cylinder 250 and the pressure within the chamber 296 of the lower cylinder 250. Similarly, the reed type check valves 247 and 249 are closed to prevent communication between the supercharger chamber 296 and the transfer manifold due to the pressure differential between the transfer manifold 240 and the supercharger chamber 296.

In the embodiment of FIG. 2, the supercharger chamber beneath the top or upper piston, such as shown in FIG. 1, is omitted. Instead, a single supercharger chamber within the lower cylinder is employed. The lower cylinder is greater in diameter than the upper cylinder, resulting in more volume in the single supercharger chamber than with either supercharger chamber of the embodiment of FIG. 1. The functioning of the supercharger piston 280, with its axially spaced apart intake ports, and the transfer apertures 266 and 248 with their reed type check valves, is substantially the same in operation as with respect to the supercharger chambers illustrated in FIG. 2.

For purposes of structural integrity, the bulkhead 230 is fitted around and through the juncture of the cylinders 200 and 250, and apertures, such as apertures 216 and 218, extend through the lower cylinder wall 250 to provide communication between the transfer manifold 240 within the bulkhead 230 and in the interior of the cylinder 250 within the bulkhead 230.

From the two embodiments illustrated, four variations in self-supercharging engines may be deduced. First is the embodiment shown in FIG. 1, which includes two cylinders having the same diameter, with a piston in each cylinder and two supercharger chambers defined. A bulkhead separates the two cylinders and a supercharger chamber is disposed on both sides, top and bottom, of the bulkhead.

A second embodiment, taken from the teachings of FIG. 2 as applied in FIG. 1, comprises a single supercharger chamber, utilizing only the bottom piston for super-charging action.

A third embodiment is illustrated in FIG. 2, in which the second or bottom cylinder and piston are larger in diameter than the first or top cylinder and piston. A single supercharger chamber is employed, using the bottom cylinder and piston only.

A fourth embodiment or variation, taken from the teachings of FIG. 1 as applied to FIG. 2, comprises dual supercharger chambers, with the lower chamber having a greater diameter than the upper chamber.

The term "supercharging" denotes the action of putting more air into a combustion chamber than it normally aspirates. The term "supercharger" broadly refers to apparatus for accomplishing the supercharging action. The term "self-supercharging" indicates that separate apparatus is not required for supercharging, such as an air pump. Rather, the engine accomplishes the supercharging action by an auxiliary piston secured to the power piston and providing an auxiliary flow of air to the combustion chamber.

As used herein, the terms "pumping," and "displacing" are substantially synonymous. Both refer to the flow of air in and from the "supercharger" or "supercharging" chambers to the bulkhead and the transfer manifold and, ultimately, to the combustion chamber.

While a specific number of reed valves is shown in the drawing and is discussed herein, it is obvious that more or less valves may be used, depending on the requirements and design considerations of any particular engine. Moreover, while a carburetor is shown in the drawing, it is obvious that the operation of the present invention is not limited to carburetion type fuel supply systems. Rather, any type of fuel supply system may be employed. Further, the self-supercharging apparatus of the present invention is not limited in its applicability to a four stroke spark ignition engine, but may be used with a diesel type engine or with a two stroke engine.

What is claimed is:

1. Dual piston self-supercharging internal combustion engine apparatus comprising, in combination:

cylinder means;

a cylinder head secured to the cylinder means;

piston means including a first piston in the cylinder means and a second piston in the cylinder means connected to and moving with the first piston;

a combustion chamber in the cylinder means between the cylinder head and the first piston;

a bulkhead disposed between the first and second pistons;

supercharger chamber means in the cylinder means adjacent the bulkhead means;

a plurality of intake ports extending through the cylinder means and separated from each other axially and communicating with the supercharger chamber means for providing a flow of air into the supercharger means in response to movement of the piston means;

a plurality of reed type check valves for controlling the flow of air into the supercharger chamber means through the plurality of axially separated intake ports;

transfer manifold means extending from the bulkhead to the combustion chamber for transferring air from the supercharger chamber means to the combustion chamber;

aperture means in the bulkhead communicating between the supercharger chamber means and the transfer manifold means; and reed type check valve means for controlling the flow of air from the supercharger chamber means into the transfer manifold means through the aperture means.

2. The apparatus of claim 1 in which the transfer manifold means includes a carburetor between the combustion chamber and the supercharger chamber means for supplying a mixture of fuel and air to the combustion chamber.

3. The apparatus of claim 1 in which the supercharger chamber means includes a first supercharger chamber between the first piston and the bulkhead means and a second supercharger chamber between the bulkhead means and the second piston.

4. The apparatus of claim 3 in which the cylinder means includes a first cylinder disposed on one side of the bulkhead and the first piston is disposed in the first cylinder and the combustion chamber is between the first piston and the cylinder head, and the first supercharger chamber is between the first piston and the bulkhead.

5. The apparatus of claim 4 in which the cylinder means further includes a second cylinder and the second piston is disposed in the second cylinder, and the second supercharging chamber is disposed between the second piston and the bulkhead.

6. The apparatus of claim 1 in which the cylinder means includes a first cylinder disposed on one side of the bulkhead and a second cylinder disposed on the other side of the bulkhead and the first and second pistons are disposed respectively in the first and second cylinders.

7. The apparatus of claim 6 in which the combustion chamber is disposed between the first piston and the cylinder head.

8. The apparatus of claim 7 in which the supercharger chamber means includes a first supercharger chamber disposed between the first piston and the bulkhead and a second supercharger chamber disposed between the second piston and the bulkhead.

9. The apparatus of claim 7 in which the second cylinder has a diameter greater than the diameter of the first cylinder.

10. The apparatus of claim 9 in which the supercharger chamber means is disposed in the second cylinder.

11. The apparatus of claim 10 in which the transfer manifold means includes a carburetor between the supercharger chamber means and the combustion chamber.

12. The apparatus of claim 7 in which the supercharger chamber means is disposed in the second cylinder.

13. The apparatus of claim 12 in which the transfer manifold means includes a carburetor between the supercharger chamber means and the combustion chamber.

14. The apparatus of claim 1 in which the transfer manifold meass includes fuel supply means disposed between the supercharger chamber means and the combustion chamber means.

15. The apparatus of claim 14 in which the cylinder means comprises a first cylinder and a second cylinder, and the first piston is in the first cylinder and the second piston is in the second cylinder.

16. The apparatus of claim 15 in which the diameter of the first cylinder and first piston is less than the diameter of the second cylinder and second piston.

17. Dual piston self-supercharging internal combustion engine apparatus, comprising, in combination:

first cylinder means;

a cylinder head for the first cylinder means;

a first piston disposed and movable in the first cylinder means a combustion chamber defined in the first cylinder means between the first piston and the cylinder head;

second cylinder means disposed coaxially with the first cylinder means;

a second piston disposed and movable in the second cylinder means;

first intake port means, including a plurality of axially spaced intake ports and a reed type check valve for each port of the plurality of ports, extending through the second cylinder means for providing a first flow of air into the second cylinder means;

bulkhead means disposed between the first cylinder means and the second cylinder means, including an upper wall, a lower wall, and an outer wall, said upper, lower, and outer walls comprising transfer manifold means for receiving the first flow of air to the combustion chamber; and fuel supply means disposed in the transfer manifold means between the second cylinder means and the combustion chamber.

18. The apparatus of claim 17 in which the first piston and the second piston are secured together by a piston rod.

19. The apparatus of claim 18 in which the bulkhead means includes an inner wall and the piston rod extends through the inner wall.

20. The apparatus of claim 19 in which the lower wall of the bulkhead means inlcudes first aperture means communicating between the second cylinder means and the transfer manifold means, and second valve means for controlling the first flow of air from the second cylinder means and the transfer manifold means through the first aperture means.

21. The apparatus of claim 20 in which the first aperture means comprises a plurality of apertures, and the second valve means comprises a plurality of reed type check valves.

22. The apparatus of claim 21 in which the diameter of the second cylinder means and the second piston is greater than the diameter of the first cylinder means and the first piston.

23. The apparatus of claim 21 in which the first cylinder means includes second intake port means for providing a second flow of air into the first cylinder means between the first piston and the bulkhead means.

24. The apparatus of claim 23 in which the bulkhead means includes second aperture means in the upper wall communicating between the first cylinder means and the transfer manifold means for admitting the second flow of air from the first cylinder means to the transfer manifold means.

25. The apparatus of claim 24 in which the bulkhead means further includes reed valve means for controlling the second flow of air through the second aperture means.

* * * * *